United States Patent [19]

Lindstrom

[11] Patent Number: 4,750,566

[45] Date of Patent: Jun. 14, 1988

[54] RESILIENT CONNECTING MEANS FOR LIFTING VIBRATORY DEVICE

[75] Inventor: Edgar K. Lindstrom, Wichita, Kans.

[73] Assignee: J. I. Case Company, Racine, Wis.

[21] Appl. No.: 915,626

[22] Filed: Oct. 6, 1986

[51] Int. Cl.[4] ..... A01B 11/00; E02F 5/32

[52] U.S. Cl. ..... 172/40; 172/484; 173/49; 37/DIG. 18

[58] Field of Search ..... 172/484, 40, 482, 464, 172/474; 37/DIG. 18; 289/14; 173/49; 405/182

[56] References Cited

U.S. PATENT DOCUMENTS

| | | | |
|---|---|---|---|
| 2,593,679 | 4/1952 | Kaupke | 172/604 X |
| 2,737,094 | 3/1956 | Jackson | 172/40 |
| 3,618,237 | 11/1971 | Davis | 172/40 |
| 3,935,712 | 2/1978 | Erickson | 172/40 X |
| 4,102,403 | 7/1978 | Steinberg | 37/DIG. 18 |
| 4,260,290 | 4/1981 | Flippin | 172/40 X |

FOREIGN PATENT DOCUMENTS

| | | | |
|---|---|---|---|
| 270985 | 2/1966 | Australia | 172/699 |

*Primary Examiner*—Richard J. Johnson
*Attorney, Agent, or Firm*—Peter N. Jansson, Ltd.

[57] ABSTRACT

An improved vehicle-mounted lifting apparatus for a vibratory device. The apparatus includes bearings in which a principal pivot shaft is journaled, a lifting link and at least one center-bonded joint spaced along and nonrotatably mounted on the pivot shaft, a lift cylinder secured to the vehicle and extending to the lifting link, and a rigid arm extending from each center-bonded joint to a support for the vibratory device. Although a compact simplified lifting structure, excellent vibratory isolation to protect the lift cylinder is provided.

5 Claims, 1 Drawing Sheet

RESILIENT CONNECTING MEANS FOR LIFTING VIBRATORY DEVICE

FIELD OF THE INVENTION

This invention is related generally to apparatus for attachment of vibratory tools to tractors and similar vehicles and, more particularly, to vehicle-mounted lifting apparatus for vibratory equipment.

BACKGROUND OF THE INVENTION

Vibratory devices, such as vibratory plows of the type used to dig trenches for cable laying and the like, are typically supported by tractors or other work vehicles which move them along the ground during their operation. Positioning such vibratory devices for use or nonuse and minimizing the problems associated with vibration are principal concerns with such equipment.

Such vibratory devices are usually supported by a vehicle-mounted lifting apparatus of the type having a support for the vibrator, various connecting means between the support and the vehicle, an hydraulic (or other) lift cylinder, and some sort of damping means (such as center-bonded joints or other elastomeric means) at one or more locations along the connecting means to isolate the vibration from the vehicle and/or from the lift cylinder.

Using some sort of vibration damping means between the vibratory device and the lift cylinder is highly advisable. The strong vibration necessary for digging a trench or carrying out other types of field work with a vibratory device can be destructive of certain parts of the lift cylinder. If not properly isolated from the strong vibrations caused by the vibratory device, the lift cylinder can easily become damaged and inoperative.

Examples of equipment of the prior art for vehicle-mounted adjustable support of vibratory devices include those described in U.S. Pat. Nos. 3,618,237 (Davis), 3,363,423 (Davis), 3,746,100 (Hall et al.), and 4,102,403 (Steinberg).

The devices of the prior art have a number of problems and disadvantages. They tend to be quite complex in construction. Some of them require a number of elastomeric pads and bearings in various places to provide sufficient laboratory isolation. Others require a plurality of pivots in order to raise and lower the vibratory attachment. Still others, while providing some vibration damping between the vibratory device and the vehicle, fail to adequately protect the lift cylinder.

Center-bonded joints, sometimes called bonded torsional bushings or elastic torque cushioning elements, have been widely used for vibratory isolation in vehicle-mounted devices for lifting vibratory implements. U.S. Pat. No. 3,618,237 (Davis) is an example. However, such vehicle-mounted lifting devices of the prior art has tended to be extremely complex.

In particular, the connecting means between the support for the vibratory device and the vehicle typically involves a number of mechanical parts arranged in series and/or a plurality of separate principal pivot points along such series of parts. Such complex structures and linkages have been required to provide both the required lifting characteristics and the required vibration damping by center-bonded joints or otherwise.

A need exists for an improved simplified vehicle-mounted lifting apparatus which is easy to understand and operate, but still provides good vibratory isolation for the vehicle and for sensitive lift cylinders.

OBJECTS OF THE INVENTION

It is an object of this invention to provide an improved vehicle-mounted lifting apparatus for vibratory devices which overcomes some of the problems and shortcomings of the prior art.

Another object of this invention is to provide a vehicle-mounted lifting apparatus for vibratory devices which protects its lift cylinder from damage without the need for a complex structure for vibratory isolation.

Another object of this invention is to provide a vehicle-mounted lifting apparatus for vibratory devices which is compact, simple in construction, and easy to operate.

Another object of this invention is to provide a vehicle-mounted lifting apparatus for vibratory devices which requires only a single principal pivot point and a single rigid arm as the connecting means between the vehicle and the vibratory device.

These and other important objects will be apparent from the descriptions of this invention which follow.

SUMMARY OF THE INVENTION

This invention is a vehicle-mounted lifting apparatus for vibratory devices. The invention is an improvement in the type of lifting apparatus which has a support for the vibratory device, connecting means between the support and the vehicle, a lift cylinder, and one or more center-bonded joints between the support and the cylinder.

The invention includes bearing means fixed with respect to the vehicle, preferably a pair of spaced coaxial shaft bearings, and a principal shaft journaled in the bearing means. Only one such principal pivot shaft is required, although in preferred embodiments a second pivot shaft which is connected in parallel with the first principal shaft can be used.

A lifting link is nonrotatably mounted on and extends radially from the shaft, and a lift cylinder, preferably the double-acting type, is positioned to rotate the pivot shaft in its bearing means by moving the lifting link. The lift cylinder is anchored at one end with respect to the vehicle and extends at its other end to the lifting link, where it is secured.

At least one center-bonded joint is nonrotatably mounted on (keyed to) the pivot shaft. For each center-bonded point on the shaft there is a rigid arm secured at one end in some way to such center-bonded joint and at the other end to the support for the vibratory device. As the lift cylinder moves the lifting link, the principal shaft and the center-bonded joints thereon rotate. This action causes movement of the rigid arm or arms through an arc and such action lifts the support and the vibratory device on it.

In preferred embodiments, there are a plurality of such center-bonded joints on the shaft and a plurality of such rigid arms, one for each center-bonded joint. Most preferably, there are two center-bonded joints spaced along the pivot shaft.

The most highly preferred embodiment includes a second pair of coaxial bearing means, a second pivot shaft journaled in such second pair of bearings, a second lifting link nonrotatably mounted on the second shaft, and a bar or other rigid linking means extending between the lifting links on the two pivot shafts such that they move in tandem under the control of the lift cylinder.

In such preferred configuration, one or more additional center-bonded joints are nonrotatably mounted on the second shaft, and for each additional center-bonded joint there is an additional rigid arm connecting it to the support for the vibratory device. Such additional pivot shaft, center-bonded joints, and rigid arms are in parallel, rather than in series. The use of such additional structure in parallel, rather than complicating the structure, serves to increase the total torsional load which can be carried by the lifting mechanism.

It is most preferred to have a pair of center-bonded joints and a pair of rigid arms for each of the preferred two pivot shafts. Each of such rigid arms may be pivotably connected directly to the support for the vibratory device, and this creates a trapezoidal framework which provides a support with excellent strength. Depending on the relative lengths of the sides of such trapezoid, the lifting action may also be used to change the orientation of the support for the vibratory device and the orientation of any vibratory tool supported on it.

DETAILED DESCRIPTION OF PREFERRED EMBODIMENTS

Figure 2:
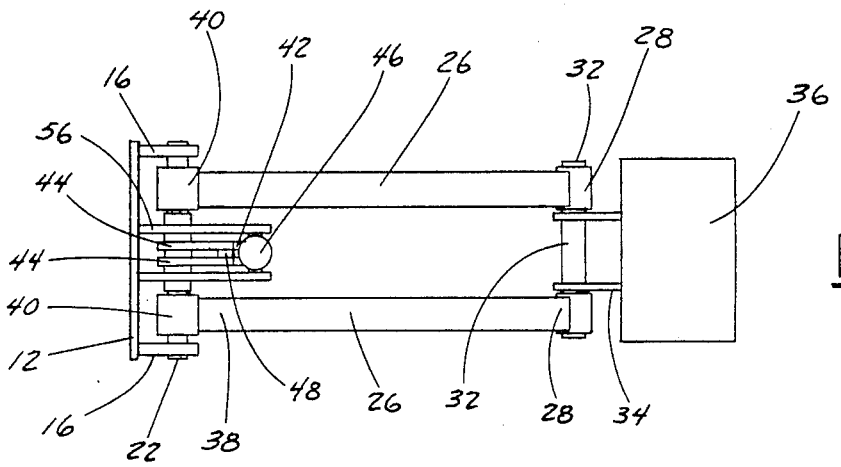
FIG. 2 is a top plan view of FIG. 1.

The figures illustrate a vehicle-mounted lifting apparatus 10 in accordance with this invention. Lifting apparatus 10 includes a mounting plate 12 which is part of a tractor or attached with respect to a tractor, preferably at its rear end.

A first pair of vertical ears 14 and a second pair of vertical ears 16 are affixed to mounting plate 12, extending therefrom in a rearward direction. A bearing opening 18 extends through each of the four ears. The two vertical ears 14 are axially aligned, that is, they are aligned such that their bearing openings 18 have a common axis. Likewise, the two vertical ears 16 are coaxially aligned with each other, but are spaced above vertical ears 14 such that the axes of their bearing openings 18 are parallel.

A first principal pivot shaft 20 is journaled in bearing openings 18 of vertical ears 14, and a second principal pivot shaft 22 is journaled in bearing openings 18 of vertical ears 16. First and second principal pivot shafts 20 and 22 are parallel and horizontally oriented. A first pair of rigid arms 24 extend from first principal pivot shaft 20 and a second pair of rigid arms 26 extend from second principal pivot shaft 22. The rigid arms 24 are vertically aligned with the rigid arms 26. Each of the four arms 24 and 26 include distal ends 28 which are pivotably mounted on shafts 30 or 32 each of which are secured to and part of a support 34 to which vibratory device 36 is attached.

Figure 4:
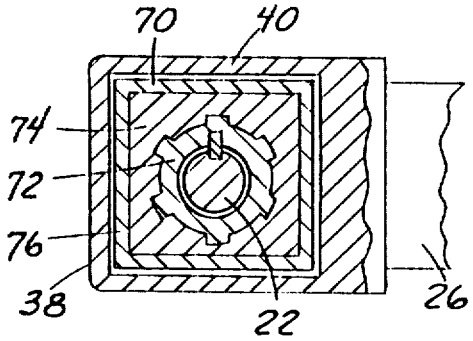
FIG. 4 is a partially broken-away sectional view of the portion indicated in FIG. 2, schematically illustrating a center-bonded joint used in this invention.

Each of the four rigid arms 24 and 26 also has a proximal end 38 which includes an enclosure 40 for a center-bonded joint 70, as shown in FIG. 4. Each of the four joint enclosures 40 contains and nonrotatably holds a center-bonded joint 70. The nonrotatable containment is by virtue of the square cross sectional configuration of both the center-bonded joints 70 and their respective joint enclosures 40. A keyed, bonded or other similar nonrotatable attachment could be used if a round joint is used.

Center-bonded joints 70 also include a center cylindrical portion 72 which is keyed to the pivot shaft (for example, pivot shaft 22 as shown in FIG. 4) extending through the joints such that each of the center-bonded joints is nonrotatably mounted on its pivot shaft.

Such center-bonded joints, frequently referred to as bonded torsional bushings or elastic torque cushioning elements, are well known devices. They include an elastomeric material 72 such as hard rubber in the space between their cylindrical center portions 72 and their outer portions 76, which in this case are square but could be round or some other shape. Such elastomeric material serves to dampen any vibration which is on either side of such elastomeric material. In this case, of course, the four rigid arms 24 and 26 undergo substantial vibratory motion by virtue of their attachment to support 34 to which vibratory device 26 is secured.

Between the two center-bonded joints on pivot shaft 20 are a pair of lifting links 42 which together form a first lifting link. Likewise, a second pair of lifting links 44 on pivot shaft 22 between the two center-bonded joints on such shaft form a second lifting link. Lifting links 42 and 44 are nonrotatably mounted on first and second pivot shafts 20 and 22, respectively. Links 42 and 44 could be of alternate design such as a single link instead of a pair of links.

The lifting force of a hydraulic lift cylinder 46 is transferred to first and second pivot shafts 20 and 22 by means of lifting links 42 and 44, respectively. A connecting link 48 (or plural links in possible alternate designs) extending between lifting links 42 and lifting links 44 causes the first and second lifting links move in tandem under the control of lift cylinder 46. Lift cylinder 46 has a rod 50 which is secured to the distal ends 52 of lifting links 42. The other end of lift cylinder 46 is attached by a connector 54 to the ends of two mounting ears 56 which are affixed to mounting plate 12 in a position above vertical ears 14 and 16.

During operation, vibratory device 36 imparts a vibration to support 34 and to a trenching blade 58 or other tool attached thereto. Vibration is transmitted along the first and second pairs of rigid arms 24 and 26 toward the first and second pivot shafts 20 and 22 to which they are secured. By virtue of the center-bonded joints which connect proximal ends 38 of rigid arms 24 and 26 to their respective shafts, the vibration of vibratory device 36 is substantially isolated from lift cylinder 46 and from the vehicle on which lifting apparatus 10 is mounted.

Figure 1:
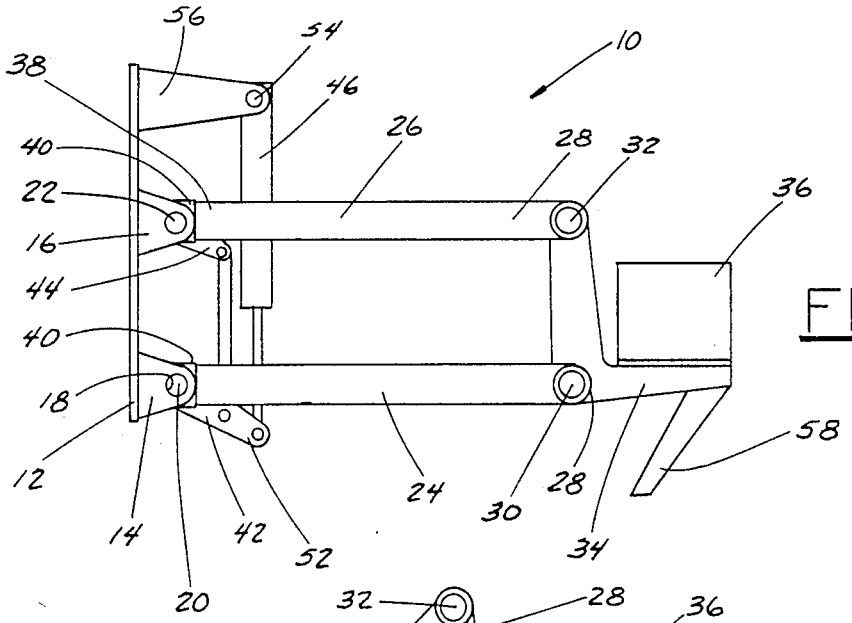
FIG. 1 is a side elevation of a preferred vehicle-mounted lifting apparatus in accordance with this invention.
Figure 3:
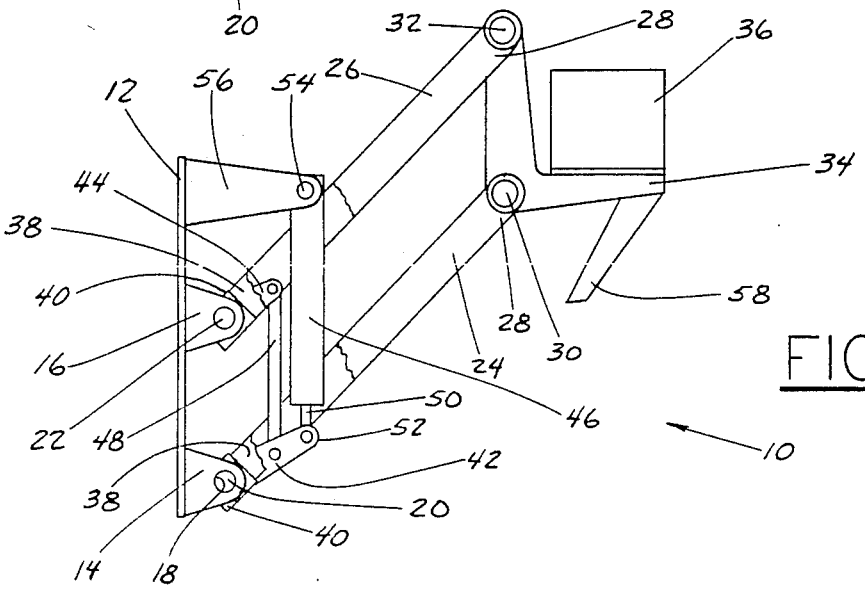
FIG. 3 is another side elevation which is partially cut-away and which illustrates the lifting apparatus in a raised position.
Figure 2:
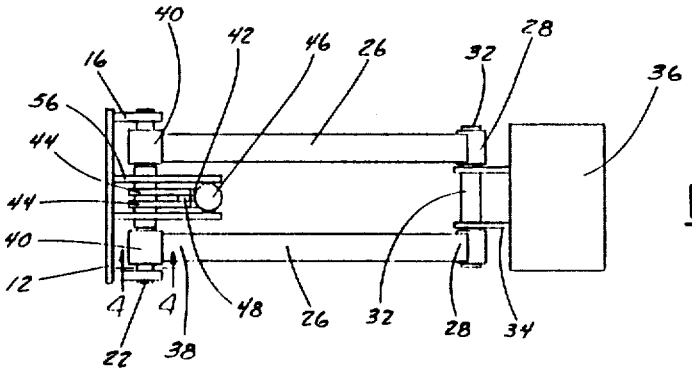

Lift cylinder 46, which is double-acting, moves the two pairs of rigid arms 24 and 26, support 34, and vibratory device 36 in a downward direction when cylinder rod 50 is extended, as shown in FIG. 1. When cylinder rod 50 is retracted, as shown in FIG. 3, the first and second lifting links 42 and 44 and their connecting link 48 are moved upwardly, which in turn rotates first and second pivot shafts 20 and 22 in a counterclockwise direction, causing the two pairs of rigid arms 24 and 26 to move in an upward direction to lift support 34 and vibratory device 36.

If the load is sufficiently light, as few as one rigid arm and one center-bonded joint may be used in the apparatus of this invention. However, it is highly preferred to have a pair of center-bonded joints and rigid arms on a single shaft and most highly preferred to have two pairs on two different shafts, as shown in the drawings.

The center-bonded joints can be made wider, that is, can each extend along a greater length of the shafts on which they are mounted, if it is desirable to give greater torsional strength to the lifting apparatus. This is helpful when particularly heavy loads are expected. In the alternative, additional center-bonded joints and rigid arms can be included on their respective shafts, or additional pivot shafts (arranged in parallel with respect to shafts 20 and 22) can be used.

Center-bonded joints may be obtained from various sources and may be tailor-made to the specific requirements of the particular vehicle-mounted lifting apparatus on which they are used. One source is Imperial Clevite, of Milan, Ohio. The other parts of this invention are made using sturdy metal pieces of a type well known in the art.

While the principles of this invention have been described in connection with specific embodiments, it should be understood clearly that these descriptions are made only by way of example and are not intended to limit the scope of the invention.

What is claimed:

1. Lifting apparatus for a vehicle-mounted vibratory device secured on a vibratory-device support, comprising:

a shaft rotatably mounted with respect to the vehicle;

a rigid lifting link affixed to and extending radially from the shaft;

a lift cylinder anchored at one end with respect to the vehicle and extending to the lifting link;

a center-bonded joint affixed to the shaft in position spaced from the lifting link; and a rigid arm having a proximal end and a distal end, the proximal end connected to the center-bonded joint and the distal end connected to the vibratory-device support such that during lifting and suspension the weight of the vibratory device and support is applied as torque in the center-bonded joint, thereby providing both lift and vibratory isolation through a single element.

2. The apparatus of claim 1 wherein there are a plurality of said center-bonded joints on the shaft and a plurality of said rigid arms.

3. The apparatus of claim 2 wherein the plurality of center-bonded joints includes two center-bonded joints spaced on the shaft.

4. The apparatus of claim 2 further comprising:

a second bearing means fixed with respect to the vehicle;

a second shaft journaled in the second bearing means;

a second lifting link nonrotatably mounted on and extending from the second shaft;

means linking the lifting links such that they move in tandem under the control of the cylinder;

at least one additional center-bonded joint nonrotatably mounted on the second shaft; and at least one additional rigid arm each connected at one end to one of the additional center-bonded joints and at the other end to the support for the vibratory device.

5. The apparatus of claim 4 wherein there are a pair of the center-bonded joints on each of the two shafts and for each such joint one of the rigid arms.

* * * * *

UNITED STATES PATENT AND TRADEMARK OFFICE

CERTIFICATE OF CORRECTION

PATENT NO. : 4,750,566

DATED : June 14, 1988

INVENTOR(S) : Edgar K. Lindstrom

It is certified that error appears in the above-identified patent and that said Letters Patent is hereby corrected as shown below:

Figure 2 is corrected to read as per attached sheet.

Figure 4 should be added as per attached sheet.

Column 1, line 58, "has" should read -- have --.

Column 4, line 4, after "both" delete "the"

Column 4, line 16, "72" should read -- 74 --.

Column 4, line 40, after "links" insert -- to --.

Signed and Sealed this

Twenty-seventh Day of September, 1988

*Attest:*

DONALD J. QUIGG

*Attesting Officer*

*Commissioner of Patents and Trademarks*

Patent No. 4,750,566 Edgar K. Lindstrom June 14, 1988